United States Patent [19]

Martin

[11] 3,950,024

[45] Apr. 13, 1976

[54] APPARATUS FOR CARRYING DISC-SHAPED ARTICLES

[75] Inventor: Raymond S. Martin, Escondido, Calif.

[73] Assignees: James W. Smith; William E. Stevenson; Arthur P. McGill, all of San Marcos, Calif.

[22] Filed: Jan. 13, 1975

[21] Appl. No.: 540,525

[52] U.S. Cl. ..... 294/34; 206/315

[51] Int. Cl.[2] ..... A47J 45/00

[58] Field of Search ..... 224/45 R, 45 K, 45 L, 45 S, 224/5 C, 5 MC; 206/315, 444, 445; 211/41, 40, 89, 13; 294/34, 27 R, 16

[56] References Cited

UNITED STATES PATENTS

| | | | |
|---|---|---|---|
| 2,520,803 | 8/1950 | Heath | 206/315 |
| 2,602,688 | 7/1952 | Brunk | 294/27 R |
| 2,908,394 | 10/1959 | Thoweman | 211/40 |
| 2,925,914 | 2/1960 | Bobko | 211/40 |
| 2,992,848 | 7/1961 | Livensparger | 294/34 |
| 3,076,223 | 2/1963 | Reschold | 294/34 |
| 3,414,909 | 12/1968 | Provi et al. | 294/16 |
| 3,862,776 | 1/1975 | Sims et al. | 294/16 |

*Primary Examiner*—Robert J. Spar
*Assistant Examiner*—Kenneth Noland
*Attorney, Agent, or Firm*—Lyon and Lyon

[57] ABSTRACT

A device for carrying shuffleboard pucks and similar disc-shaped objects comprising a fixed strip member and a laterally movable strip member held in a common plane by a supporting frame to define a support surface. A plurality of lugs are disposed on both strip members to retain shuffleboard pucks on the aforesaid surface of the carrying device in a planar configuration upon the laterally movable strip member being drawn toward and held in close proximity to the fixed strip member.

4 Claims, 3 Drawing Figures

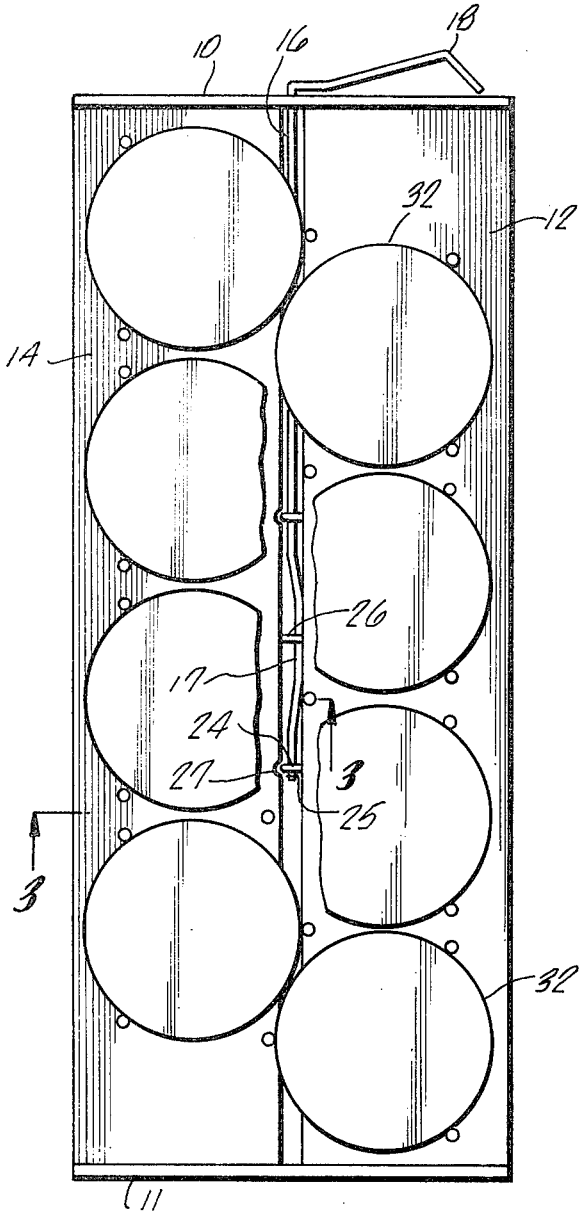
FIG 1
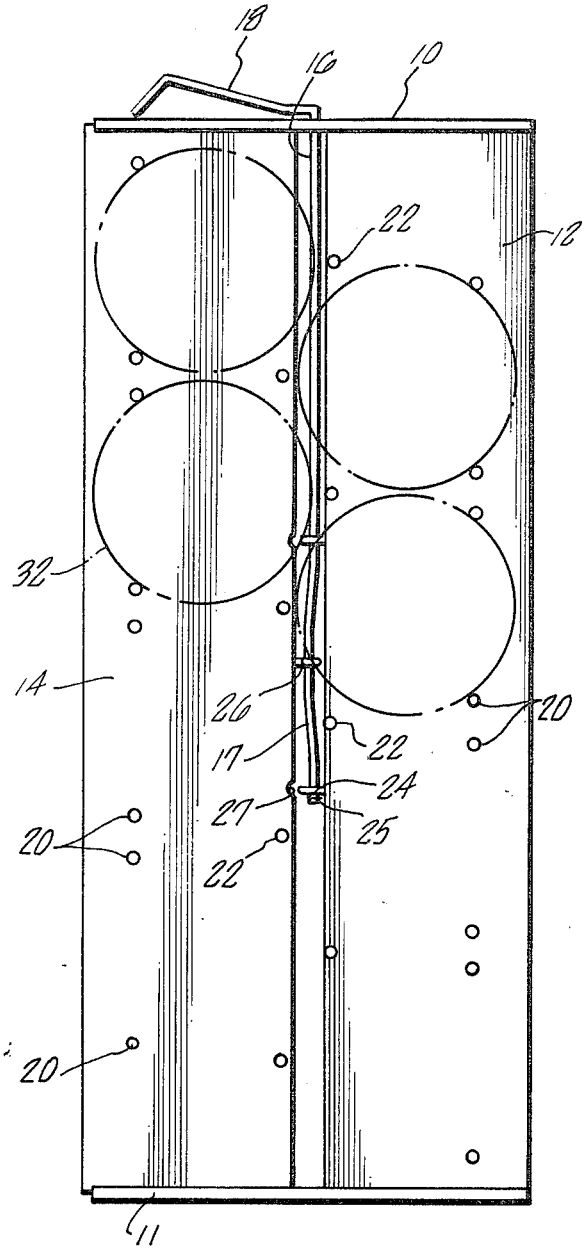
FIG 2
FIG 3
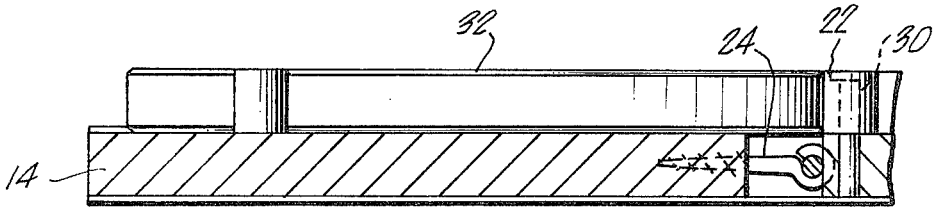

APPARATUS FOR CARRYING DISC-SHAPED ARTICLES

BACKGROUND OF THE INVENTION

The present invention relates to a device for holding and carrying disc-shaped objects and, in particular, relates to a device for holding and carrying shuffleboard pucks.

Formerly, shuffleboard players were required to carry their shuffleboard pucks in various makeshift containers, such as paper bags or boxes. Such means of transporting shuffleboard pucks have generally proved to be inconvenient and cumbersome. Additionally, in order to wax and polish a puck prior to use, it was necessary to bend down and remove the puck from the bag or box, firmly grasp the puck and then attempt to wax and polish the underside of the puck. Because shuffleboard pucks are not provided with means to facilitate holding the puck, this has proved to be a difficult task, particularly for the older players. It would be very desirable to have a device which not only facilitated the transporting of the shuffleboard pucks, but also one which held the pucks such that the undersides thereof could be readily waxed and polished prior to use without the need for individual handling of each puck.

SUMMARY OF THE INVENTION

It is the principal object of the present invention to provide a device for retaining shuffleboard pucks or the like while they are being transported or conditioned for use.

It is another object of the present invention to provide a device for carrying shuffleboard pucks which provides convenient access to such pucks.

It is yet another object of the present invention to provide a device for carrying shuffleboard pucks which maintains those pucks in a planar disposition to facilitate waxing and polishing of the underside thereof.

It is yet another object of the present invention to provide a device for retaining shuffleboard pucks while they are being transported or conditioned for use which is of simple construction and economical to manufacture. These and other objects and advantages of the present invention will become apparent from the following detailed description taken in conjunction with the accompanying drawings. Briefly, this invention relates to a device for holding and carrying disc-shaped objects or shuffleboard pucks which is comprised of a stationary longitudinal strip member and a corresponding movable longitudinal strip member which is capable of lateral movement with respect to the stationary member. The strip members are retained in a common plane by an outer frame to define a supporting surface. The supporting surface of each of the longitudinal strip members is provided with a plurality of puck retaining lugs. These lugs are so disposed that when shuffleboard pucks are placed on the supporting surfaces of the two strip members, between the various lugs, and the movable strip member is drawn toward the fixed strip member, the lugs carried by one member presses a puck against a lug carried by the other member and thereby act to retain the shuffleboard pucks firmly against the combined supporting surface. Means are provided for securing the laterally movable strip and thereby maintain the holding and carrying device in the locked position.

BRIEF DESCRIPTION OF THE DRAWINGS

FIG. 1 is a plan view of a shuffleboard puck holder according to the present invention showing the longitudinal strip members in the closed position.

FIG. 2 is a plan view of a shuffleboard puck holder according to the present invention showing the longitudinal strip members in the open position.

FIG. 3 is a cross sectional view taken substantially along Line 3—3 of FIG. 1.

DESCRIPTION OF A PREFERRED EMBODIMENT

The present invention contemplates the construction of a device for holding and carrying disc-shaped objects whenever it is desired to transport such safely, securely retained and disposed with common surfaces accessible in some manner. The drawings illustrate a preferred embodiment of a device according to the present invention which has particular application for holding and carrying shuffleboard pucks. Referring to FIGS. 1 and 2, there is shown the device for holding and carrying shuffleboard pucks comprising, generally, parallel spaced apart U-shaped end members 10 and 11, a first longitudinal strip member 12, a second longitudinal strip member 14, an actuating shaft 16 having a handle 18 and upstanding lugs 20 and 22 which are formed on both the first and second longitudinal strip members. The first longitudinal strip member 12 is firmly affixed at each end to both U-shaped members 10 whereas the second strip member 14 is only slidably retained by end members 10 and 11. As the handle 18 of the actuating means 16 is rotated, the second longitudinal strip member 14 is moved laterally with respect to the stationary first longitudinal strip member 12.

Describing now the various elements of the shuffleboard puck holder in more detail, FIG. 1 shows a preferred form of the device with the shuffleboard pucks retained therein. The two parallel spaced apart U-shaped end members 10 and 11 are each provided with a channel which runs along the entire length of the members. As can be seen, the two longitudinal strip members 12 and 14 are inter-fitted into these channels. The first longitudinal strip member 12, which preferably has a width of approximately less than one-half the length of end members 10 and 11, is inserted into the channels formed in the U-shaped members and securely attached thereto. The second longitudinal strip member 14 is inserted into the remaining portion of the channels and is slidably retained therein. The second longitudinal strip member 14 is capable of lateral movement with respect to the first longitudinal strip member 12 from a closed position, as shown in FIG. 1, where the strip members are almost contiguous, to an open position, as shown in FIG. 2, where the strip members are spaced apart. Actuating shaft 16 is positioned between the two longitudinal strip members and extends out to the top of the device through an aperture (not shown) formed in end member 10. The shaft 16 is formed with crank arm 17 which is displaced from the center line of the shaft. The shaft is also provided with a handle 18 which is preferably V-shaped to facilitate grasping and rotating of the actuating shaft. The shaft extends through retaining rings 24 and 26 which are affixed to longitudinal strip members 12 and 14 and function to connect the actuating shaft to the strip members. FIG. 3 shows retaining rings 24 affixed to strip member 12. The lower ring 24 is preferably provided with retaining means 25 to prevent the actuating shaft 16 from undergoing vertical movement. Crank arm 17 of actuating means 16 is positioned in retainer ring 26. When the strip members are in the closed position, the retainer rings are recessed into grooves 27 formed in the opposing strip member.

One surface of both longitudinal strip members is provided with a plurality of upstanding lugs 20 and 22. Lugs 20 are positioned near the outer edge of the strip members and lugs 22 are positioned near the inner edge of the strip members. The lugs are positioned so that two outer lugs 20, positioned on one strip, form a triangle with a third inner lug 22, positioned on the opposing strip. Lugs 20 form the base of the triangle and lug 22 forms the apex of the group. Several groups of lugs are provided, each to grasp and retain one shuffleboard puck. The lugs are preferably provided with a rubber cap 30 which facilitates retention of the shuffleboard puck.

To transport the shuffleboard pucks 32, each puck is placed in one of the several triangular spaces provided in each group of lugs. Then handle 18 is rotated by moving the end 34 of the handle 18 thereby moving crank arm 17 from a position, where it is next to strip member 12, 180 degrees to a position, where it is contiguous to strip member 12 once more. Strip member 14 is thereby slidably impelled towards stationary strip member 12 in the channels formed in the U-shaped members. Lugs 20 and 22 are correspondingly moved together thereby securely retaining the pucks. The pucks can now be easily and safely transported. Since one surface of each puck is disposed in a common plane, the pucks can also be easily waxed and conditioned prior to use. To remove the pucks, the handle is merely moved out of the cavity formed in the end channel 10 and rotated back to its original position, thereby moving lugs 20 and 22 away from one another, freeing the shuffleboard pucks.

While only one particular embodiment and application of this invention has been shown and described, it will be apparent to those skilled in the art that many more modifications are possible without departing from the inventive concepts herein described. The invention, therefore, is not to be restricted except as is necessary by the prior art and by the spirit of the appended claims.

I claim:

1. A device for retaining a plurality of disc-shaped objects comprising:

first and second strip members arranged side-by-side in co-planar relationship, two spaced-apart end retaining means each engaging one end of each of said strip members, the first one of said strip members being fixedly secured to the retaining means at each end thereof, the second strip member being laterally slidable within said retaining means with respect to said first strip member;

actuating means cooperatively coupled between said first and second strip members for moving said second strip member laterally within said end retaining means with respect to said first strip member; and a plurality of upstanding lug members affixed to said first and second strip members, said upstanding lug members being located on said strip members to cooperatively engage disc-shaped objects upon a surface of said strip members.

2. The apparatus, set forth in claim 1 wherein said actuating means comprises a crank having a shaft, said shaft extending through the retaining means, said shaft being affixed to one of said strip members and having an offset crank arm portion, said crank arm portion being movably affixed to the other of said strip members.

3. The apparatus set forth in claim 2 wherein said upstanding lug members comprise a first pair of lugs located on one of said strip members and a third lug member positioned upon the opposite strip member in a triangular configuration, whereby movement of one of said strip members toward the other upon the movement of said actuating means effectively shortens the distance between the single lug member as opposed to the opposing pair of lug members.

4. The device of claim 1 for retaining shuffleboard pucks wherein said lugs are further provided with rubber caps.

* * * * *